US011745925B2

(12) United States Patent
McCumber et al.

(10) Patent No.: US 11,745,925 B2
(45) Date of Patent: Sep. 5, 2023

(54) SEPARABLE EXTRACTION TAB ACCESSIBLE MULTIPLE BLISTER CARD PACKAGE

(71) Applicant: Placon Corporation, Madison, WI (US)

(72) Inventors: Donald E. McCumber, Madison, WI (US); Scott A. Behner, Northwood, NH (US)

(73) Assignee: Placon Corporation, Madison, WI (US)

( * ) Notice: Subject to any disclaimer, the term of this patent is extended or adjusted under 35 U.S.C. 154(b) by 0 days.

(21) Appl. No.: 18/085,373

(22) Filed: Dec. 20, 2022

(65) Prior Publication Data

US 2023/0122080 A1 Apr. 20, 2023

Related U.S. Application Data

(60) Continuation of application No. 17/133,272, filed on Dec. 23, 2020, now Pat. No. 11,560,264, which is a division of application No. 16/299,862, filed on Mar. 12, 2019, now Pat. No. 10,899,520, which is a division of application No. 15/209,526, filed on Jul. 13, 2016, now Pat. No. 10,266,327.

(51) Int. Cl.

| | |
|---|---|
| ***B65D 73/00*** | (2006.01) |
| ***B65D 75/32*** | (2006.01) |
| ***B65D 75/58*** | (2006.01) |

(52) U.S. Cl.

CPC ..... *B65D 73/0092* (2013.01); *B65D 75/322* (2013.01); *B65D 75/58* (2013.01)

(58) Field of Classification Search

CPC ... B65D 73/0092; B65D 75/322; B65D 75/58
USPC .... 206/471, 465, 464, 462, 359, 352, 209.1, 206/209, 208, 207, 206, 470, 804, 815, 206/806, 467, 461

See application file for complete search history.

(56) References Cited

U.S. PATENT DOCUMENTS

| | | | | |
|---|---|---|---|---|
| 3,246,747 | A | 4/1966 | Blish | |
| 3,333,684 | A * | 8/1967 | Martelli | B65D 73/0092 222/105 |
| 3,948,393 | A | 4/1976 | Lewi | |
| 4,191,293 | A | 3/1980 | Newman | |
| 4,210,246 | A | 7/1980 | Kuchenbecker | |
| 4,266,666 | A | 5/1981 | Kuchenbecker | |
| 4,779,734 | A | 10/1988 | Kydonieus | |
| 6,053,321 | A | 4/2000 | Kayser | |

(Continued)

FOREIGN PATENT DOCUMENTS

WO WO-2012094467 A1 * 7/2012 ..... B65D 73/0057

*Primary Examiner* — Rafael A Ortiz
(74) *Attorney, Agent, or Firm* — Stiennon & Stiennon

(57) ABSTRACT

A disposable package is configured to promote recycling of its component parts. A thermoformed thermoplastic blister has front and back product bubbles which extend from a peripheral flange and are hinged together to be folded into a product compartment such that the product bubbles extend through openings in front and back cards. The front card is affixed to the back card to close the product bubble and so as not to adhere to the blister flanges. A front extraction tab extends from the peripheral flange and is accessible on two opposed sides for gripping by a user to engage and remove the blister from the front card and the back card.

8 Claims, 4 Drawing Sheets

(56) References Cited

U.S. PATENT DOCUMENTS

| | | | | |
|---|---|---|---|---|
| 6,308,832 | B1 | 10/2001 | Pirro et al. | |
| 6,619,480 | B2 | 9/2003 | Smith | |
| 7,621,400 | B2 | 11/2009 | Smith et al. | |
| 7,726,480 | B2 | 6/2010 | Nazari | |
| 8,091,704 | B2 | 1/2012 | Trigg | |
| 8,151,988 | B2 | 4/2012 | Smith et al. | |
| 8,151,989 | B2 | 4/2012 | Appelabaum et al. | |
| 8,205,746 | B2 | 6/2012 | Nazari | |
| 8,225,933 | B2 | 7/2012 | Wade | |
| 8,251,214 | B2 | 8/2012 | Wade | |
| 8,550,250 | B2 | 10/2013 | Wade | |
| 8,616,373 | B2 | 12/2013 | Hansen et al. | |
| 8,708,146 | B2 | 4/2014 | Falcon | |
| 2007/0125666 | A1 | 6/2007 | Nazari | |
| 2009/0159479 | A1 | 6/2009 | Smith et al. | |
| 2009/0223840 | A1 | 9/2009 | Nazari | |
| 2010/0206755 | A1 | 8/2010 | Wade | |
| 2011/0017627 | A1 | 1/2011 | Wade et al. | |
| 2011/0290675 | A1 | 12/2011 | Shiue et al. | |
| 2012/0125796 | A1* | 5/2012 | Falcon | B65D 73/0092 206/468 |
| 2013/0228488 | A1 | 9/2013 | Wu et al. | |
| 2013/0284631 | A1* | 10/2013 | Hansen | B65D 43/162 206/462 |
| 2013/0319896 | A1* | 12/2013 | Corbat | B65D 73/0092 493/56 |
| 2013/0341230 | A1 | 12/2013 | Brandel et al. | |
| 2014/0291189 | A1* | 10/2014 | Morgan | B65D 5/4208 206/459.5 |
| 2014/0353198 | A1 | 12/2014 | Bradfield | |
| 2015/0021224 | A1 | 1/2015 | Vossoughi et al. | |
| 2015/0329258 | A1 | 11/2015 | Brandow | |
| 2016/0101919 | A1* | 4/2016 | Zacherle | B65D 75/36 493/90 |
| 2016/0194130 | A1* | 7/2016 | Zacherle | B65B 11/004 53/410 |
| 2019/0307240 | A1* | 10/2019 | Moskovich | B65D 75/366 |

* cited by examiner

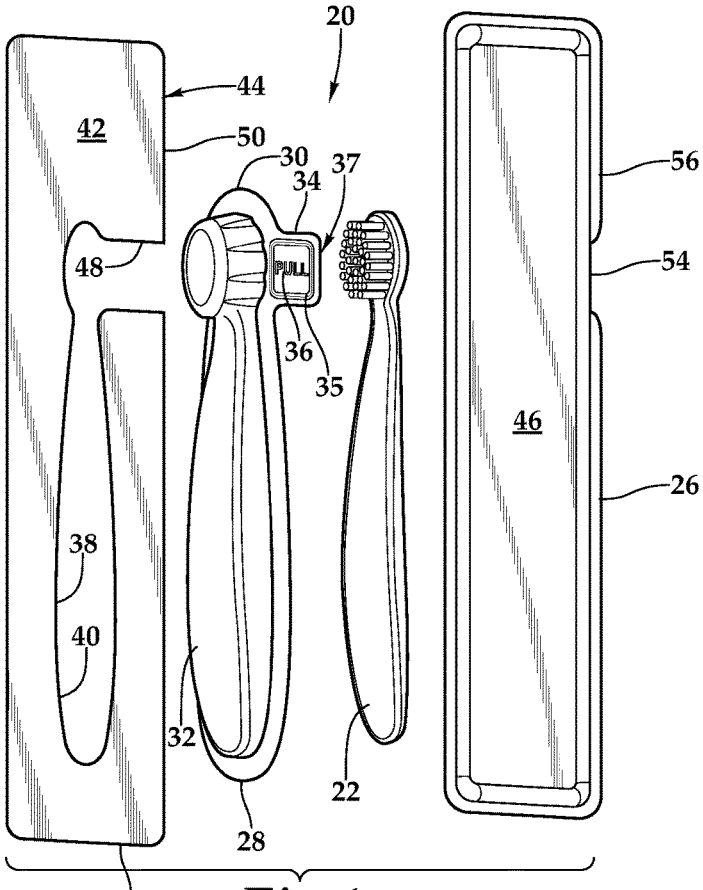
Fig.1
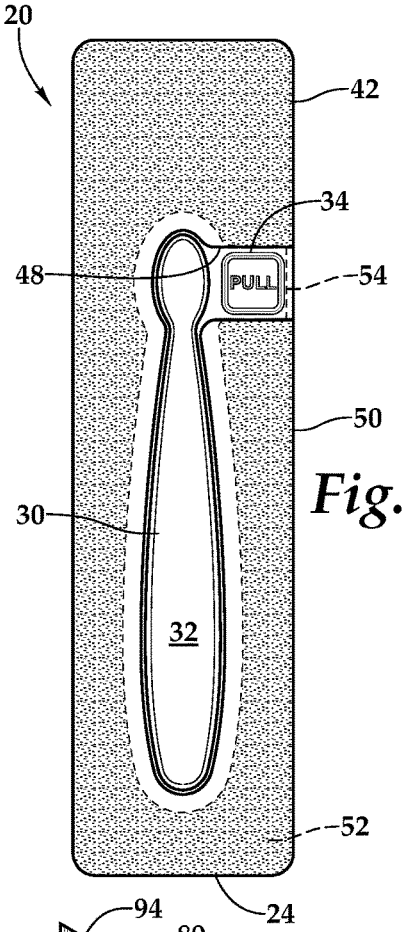
Fig.2
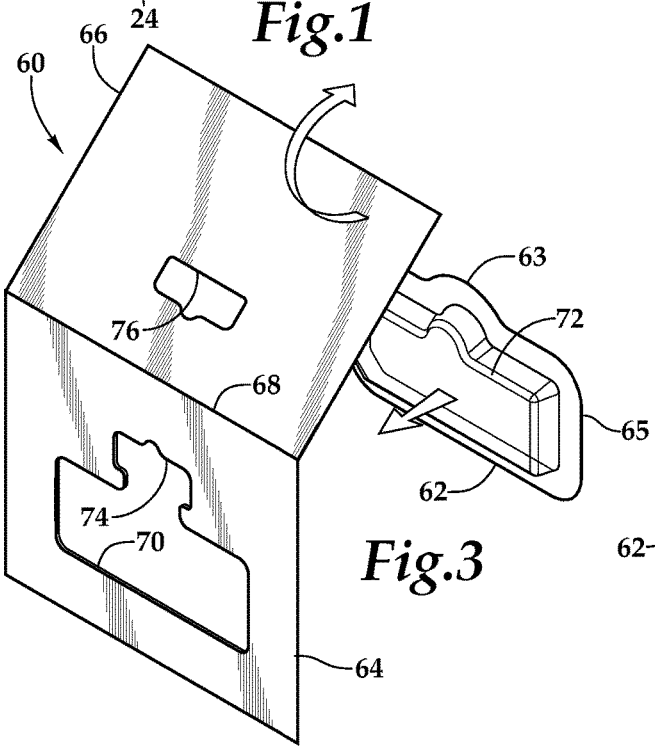
Fig.3
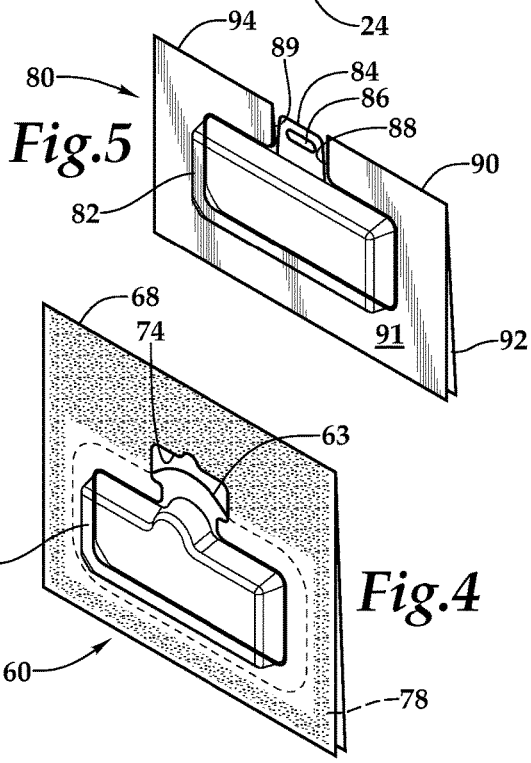
Fig.5
Fig.4

SEPARABLE EXTRACTION TAB ACCESSIBLE MULTIPLE BLISTER CARD PACKAGE

CROSS REFERENCES TO RELATED APPLICATIONS

This application is a continuation of U.S. application Ser. No. 17/133,272, filed Dec. 23, 2020, now U.S. Pat. No. 11,560,264, issued Jan. 24, 2023, which is a divisional of U.S. application Ser. No. 16/299,862, filed Mar. 12, 2019, now U.S. Pat. No. 10,899,520, issued Jan. 26, 2021 which is a divisional of U.S. application Ser. No. 15/209,526 filed on Jul. 13, 2016, now U.S. Pat. No. 10,266,327, issued Apr. 23, 2019, the disclosures of which are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to packages generally, and more particularly to packages assembled from plastic and non-plastic components.

Product packages can advantageously be manufactured from various materials. Molded transparent blisters can retain and position products for examination by the purchaser, while printed paper or cardstock elements can display images which attract the shopper's attention, distinguish and brand the product, and provide helpful or required information about the product's composition or use. Both these components can be fabricated at low cost, and are often disposed of after the product has been extracted or consumed.

The prudent customer can limit the waste stream to landfills by recycling a package which has served its use. In many municipalities recycling streams are maintained for both plastic and paper fiber materials. Yet materials are more effectively recovered when these two types of materials are not mixed. Hence a package which can be readily separated into distinct paper fiber and plastic components is a desirable enhancement to recycling material flows. There are many packaging structures that make this possible. For example, plastic clamshell containers which contain paperboard internal cards or which are ultrasonically sealed to external cards. Yet more options for package configuration and filling would be offered by a package employing adhesively adhered card elements with thermoformed thermoplastic blisters which are in no way adhered to the cards.

SUMMARY OF THE INVENTION

The plastic and paper fiber elements of a disposable package are readily separated for recycling by affixing a front card to a rear card with adhesive so as to trap the flange of a thermoformed blister between the two cards without adhering the blister to either card. The flange is generously dimensioned to accommodate the less precise positioning of the blister needed to keep it clear of contact with the card adhesive. Because of the deformable nature of a thermoformed thin-sheet part, the blister can be distorted to extract it out through an opening in the card through which the blister product bubble protrudes.

In order to give the consumer a solid engagement with the blister in order to distort it with respect to the card, the blister has an extraction tab which extends from the product bubble into an opening which is accessible to the consumer from the front and the rear of the package. In this way the consumer can grip the tab, for example between a thumb and forefinger, and securely apply force to the blister to distort it in such a way that the blister flange comes clear of the adhered cards and passes out through the opening in the front card. The distortion required to extract the blister makes it difficult to reinsert the blister between the cards without showing evidence of tampering.

The extraction tab may extend past the periphery of the card, or aligned internal openings may be provided in the front and back cards at a location adjacent the product bubble opening. The blister may have a single product bubble, or more than one, for example allowing two items to be contained with respect to a single arrangement of front and back cards, one projecting on the front, and one on the rear.

In an alternative embodiment, the extraction tab extends above the front card and has a spacer segment which supports a grip segment of the tab spaced from the front card in a manner to allow a consumer to access it from both sides.

It is an object of the present invention to provide a disposable package which is readily broken down into plastic and nonplastic components for recycling.

It is another object of the present invention to provide a blister card package where the blister can be separated from the card for access to the contained product which does not require the use of tools.

It is a further object of the present invention to provide a package which combines a thermoformed thermoplastic blister and a backing card without requiring any adhesive connection between the card and blister.

It is yet another object of the present invention to provide a package with a readily removable blister which is difficult to replace in its original configuration without showing evidence of tampering.

Further objects, features and advantages of the invention will be apparent from the following detailed description when taken in conjunction with the accompanying drawings.

BRIEF DESCRIPTION OF THE DRAWINGS

FIG. 1 is an exploded axonometric view of a package of this invention.

FIG. 2 is a top plan view of the package of FIG. 1.

FIG. 3 is an exploded isometric view of an alternative embodiment package of this invention.

FIG. 4 is an isometric view of the package of FIG. 3, with adhesively connected regions of the front and back cards shown with a tone pattern.

FIG. 5 is an isometric view of another alternative embodiment package of this invention in which the extraction tab has a hang hole therein.

DESCRIPTION OF THE PREFERRED EMBODIMENTS

Figure 6:
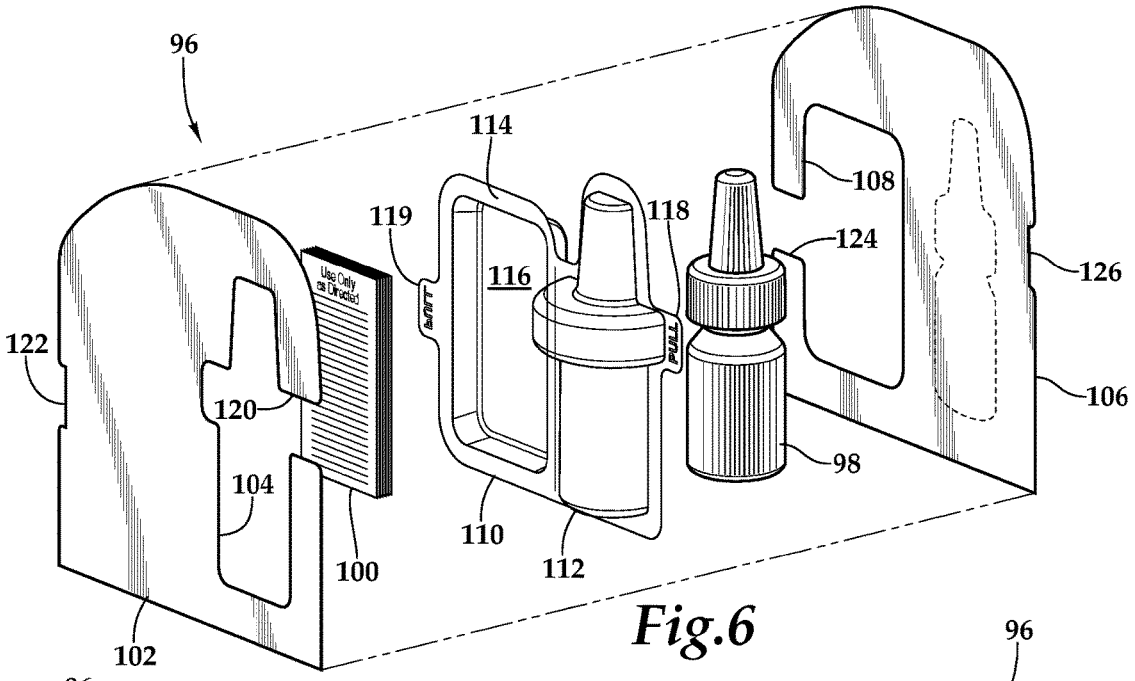
FIG. 6 is an exploded isometric view of an alternative embodiment package of this invention for two products.
Figure 7:
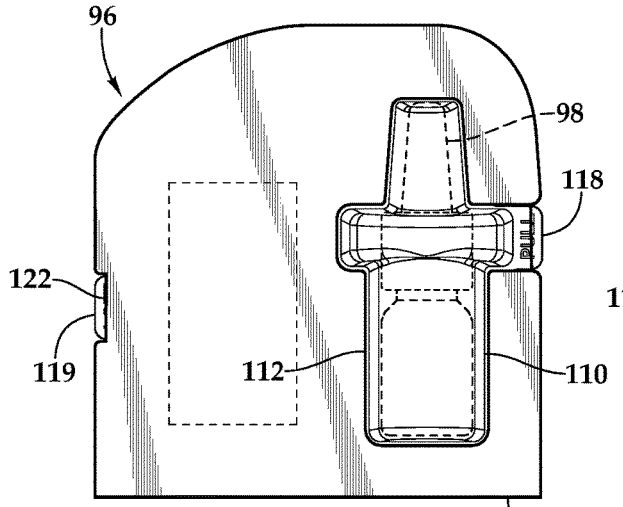
FIG. 7 is a front elevational view of the package of FIG. 6.
Figure 8:
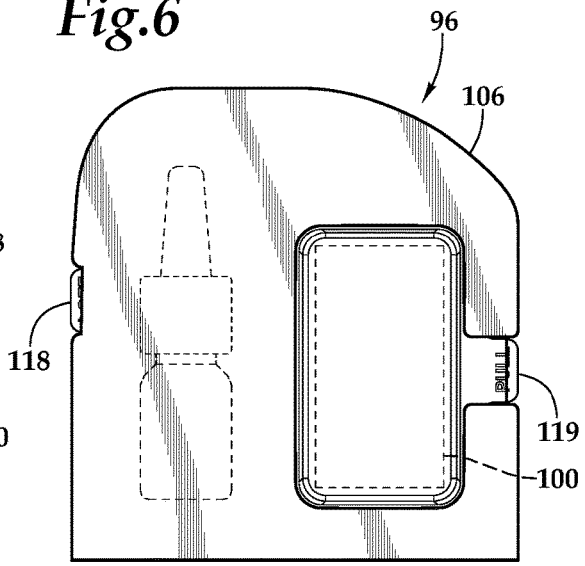
FIG. 8 is a rear elevational view of the package of FIG. 6.

Referring more particularly to FIGS. 1-17 wherein like numbers refer to similar parts, a package 20 is shown in FIGS. 1 and 2 for a product 22, for example a toothbrush. The package 20 has a front card 24 which is fixed to a back card 26 to trap the peripheral flange 28 of a thermoformed thermoplastic blister 30 therebetween.

The front card 24 may be of a paperboard or fiber material, and will preferably be suitable for printing to enable relevant decorative or informational matter to be displayed in connection with the product. The front card has an exterior surface 42 which is visible to the consumer, and an opposite interior surface 44. The back card 26 has an interior surface 46 which is affixed to the interior surface of the front card 24, for example by an adhesive. The back card 26 has an exterior surface opposite to the interior surface 46. The cards 24, 26 may be of other than wood fiber, for example the back card 26 may be a formed bamboo fiber element.

The blister 30 may be conventionally formed of, for example, PET (Polyethylene Terephthalate), or PETG (Polyethylene Terephthalate Glycol). The blister 30 has a product bubble 32 which projects frontwardly from the flange 28, and which provides a volume forward of the front card 24 for retaining and displaying the product 22. An extraction tab 34 extends outwardly from the product bubble 32, and may be a section of the flange 28, or may be specially formed to have texture to enhance the friction when gripped by a user. The texture may take the form of raised indicia 36 alerting the user to its purpose, with instructions like "pull" written on the tab. The extraction tab 34 has a front surface 35 which is accessible through the front card, and an opposite back surface 37.

The width of the flange 28 is selected to adequately retain the blister trapped between the front card 24 and the rear card 26, and thus may be wider than would be necessary if the flange were simply to be directly affixed to a card. For most applications, the flange will be at least one quarter inch wide, and could be three quarters inch or wider.

The front card 24 has a cut-out bubble opening 38 through which the product bubble 32 extends. The front card bubble opening 38 has an internal perimeter 40 which overlies the flange 28 of the blister and is positioned outwardly from the product bubble 32.

The size of the flange 28 required will depend also on the thickness of the card material; if the material is heavier, a wider flange is required. If the card material is thinner and rips readily, the flange may be narrower. Although not necessary, the ripping of the card material in the extracting of the blister is desirable, as that gives effective evidence of tampering with the package. It will be observed that, the wider the flange is, the more it has to distort in order to clear the card bubble opening. To facilitate tearing, a region of weakened material, such as a one-eighth inch slit (not shown) could be die cut in the front card extending radially outwardly from the bubble opening perimeter, for example perpendicular to the perimeter 40. Such a starter slit would tend to cause the card to rip when a user began to pull on the blister to extract it.

The bubble opening 38 includes a tab front access opening 48 which communicates with an exterior perimeter 50 of the front card 24. As indicated in the stipple pattern of FIG. 2, the back card interior surface 46 is adhered to the front card interior surface 44 along a region of adhesive 52 which does not overlap the blister 30. The blister 30 is retained by its flange 28 which is trapped between the front card 24 and the back card 26. As shown in FIG. 2, the product bubble 32 extends through the front card bubble opening 38. Thus the blister is retained to the cards 24, 26, yet the blister flange is not adhered to either the front card or the back card. In this assembled condition, the blister extraction tab 34 front surface 35 extends into the tab front access opening 48 where it is clearly visible to a user.

The back card 26 is provided with a tab back access opening 54, best shown in FIG. 1, which communicates with an exterior perimeter 56 of the back card. The tab back access opening 54 may be a shallow notch or cut-out which aligns with portions of the front access opening 48 such that the extraction tab 34 extends into the tab back access opening. The extraction tab 34 is thus free of the front card 24 and the back card 26 to be accessible at both the tab front surface 35 and the tab back surface 37 for gripping by a user to engage and remove the blister from the front card and the back card. It should be noted that the extraction tab 34 and card shapes and positions may be formed in various ways to allow the extraction tab to be accessible from its front surface and its back surface to enable the gripping of the tab 34 by a user. Some alternatives are described below.

When a consumer desires to extract the product 22 from the package 20, the consumer grips the extraction tab 34 between a thumb and index finger while holding the adhered cards 24, 26 in the other hand, and pulls on the extraction tab frontwardly to bring the tab away from the back card and through the tab front access opening 48. The tab 34, being integrally formed with the blister 30, brings the rest of the blister along with it as the bubble 32 is distorted and the blister flange 28 is pulled into the bubble opening 38 and then free of the cards entirely. The blister 30 may come free of the cards without affecting them, or it may cause one or both of the cards to tear. In any event, once separated from the cards the blister 30 is free of any card material, and the cards are free of any plastic blister material. The consumer may then make use of the product 22 while disposing of the plastic and fiber components of the package 20 for processing in separate waste recycling streams.

An alternative embodiment package 60 is shown in FIGS. 3 and 4, in which the blister 62 extraction tab 63 is accessible from openings internal to the front card 64 and back card 66. As shown in FIG. 3, the thermoformed thermoplastic blister 62 has a peripheral flange 65, a portion of which defines the extraction tab 63. The front card 64 is integrally formed with the back card 66 in a single blank, and is connected to the back card along a hinge 68. The front card 64 has a bubble opening 70 through which the blister 62 product bubble 72 protrudes. A smaller tab front access opening 74 is continuous with the bubble opening 70, and does not communicate with the exterior perimeter of the front card. The back card 66 has a tab back access opening 76 which aligns with the tab front access opening 74.

The package 20 is filled with the product, not shown, when the blank is opened up to receive the blister, and the front card is then closed upon the back card. As shown in FIG. 4, a region of adhesive 78, indicated by a stipple pattern, is positioned outwardly of the blister flange 65. The adhesive connects the front card 64 to the back card 66 without extending on to the blister flange. The portions of the flange 65 defining the extraction tab 63 extend into the aligned front and back tab access openings 74, 76. The access openings are dimensioned so as to provide adequate space for a user to grip the blister from both its front and its rear surface, and to thereby engage the blister and distort it to extract if from the cards.

It will be noted that the aligned tab access openings 74, 76 may also serve as a hang hole, to permit the package to be supported on a conventional retail peg.

Alternatively, as shown in FIG. 5, a package 80 may have a thermoformed blister 82 with an extraction tab 84 which has a through hole 86 by which the package may be mounted on a retail peg. In this form the extraction tab 84 becomes a hang tab. The tab front access opening 88 and back access opening 89 both communicate with an exterior perimeter 90 of their respective front card 91 and rear card 92, the exterior perimeter being located along the hinge 94 between the two cards, which are formed from a single blank.

Figure 9:
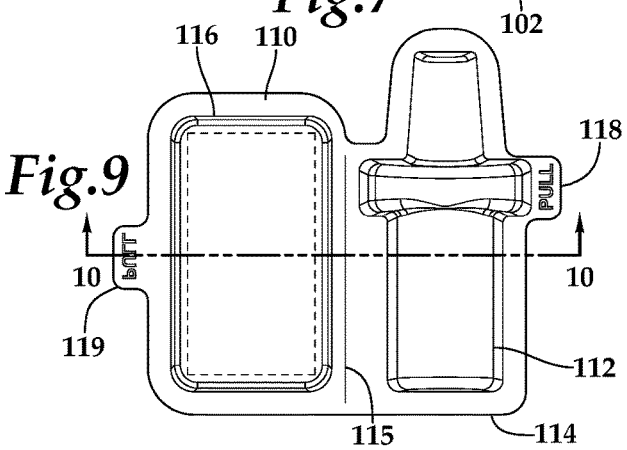
FIG. 9 is a front elevational view of the blister of the package of FIG. 6.
Figure 10:
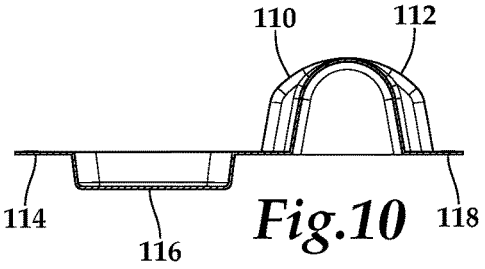
FIG. 10 is a cross-sectional view of the blister of FIG. 9 taken along section line 10-10.

An alternative embodiment package 96 is shown in FIGS. 6-10 which contains both a primary product 98, for example a bottle of medicine, and a secondary product 100, for example an instruction booklet. The package 96 has a front card 102 with a primary product bubble opening 104, and a back card 106 with a secondary product bubble opening. A thermoformed thermoplastic blister 110, best shown in FIGS. 9 and 10, has a primary product bubble 112 which projects frontwardly from a blister flange 114, and secondary product bubble 116 which projects rearwardly from the blister flange. As shown in FIG. 9, a hinge 115 extends between the primary product bubble and the secondary product bubble along the flange 114. A primary extraction tab 118 extends from the primary product bubble 112, and a secondary extraction tab 119 extends from the secondary product bubble 116.

As best shown in FIG. 6, the front card 102 has a tab front opening 120 which communicates with the primary product bubble opening 104, and a smaller tab front opening 122 which is positioned to overlie a secondary product tab back opening 124 which communicates with the secondary product bubble opening 108 in the back card 106. The back card 106 has a notch or cut-away defining a primary tab back access opening 126 which aligns with the primary tab front opening 120 of the front card 102.

Both the primary extraction tab 118 and the secondary extraction tab 119 are accessible through their respective front and back openings 120, 126 and 122, 124 and are positioned to be free of the front card and the back card to be accessible for gripping by a user to engage and remove the blister from the front card and the back card. Each of the bubbles can be opened separately, aided by the flexibility of the hinge 115, although to remove the blister entirely from the cards, it will be necessary to tear or separate the cards.

Figure 11:
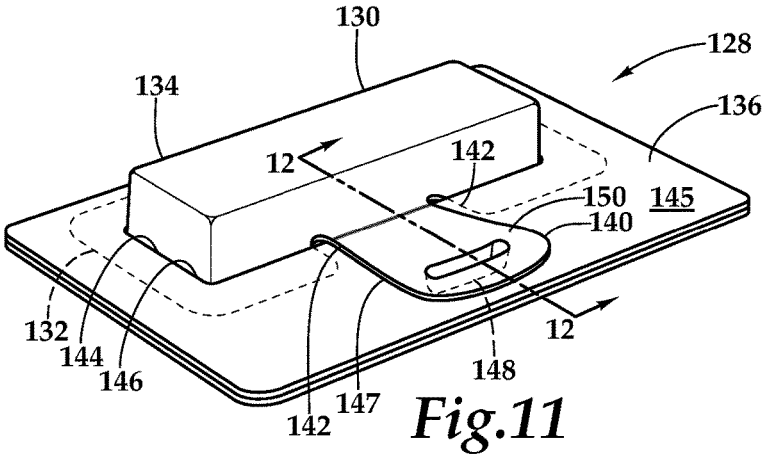
FIG. 11 is an isometric view of an alternative embodiment package of this invention.
Figure 12:
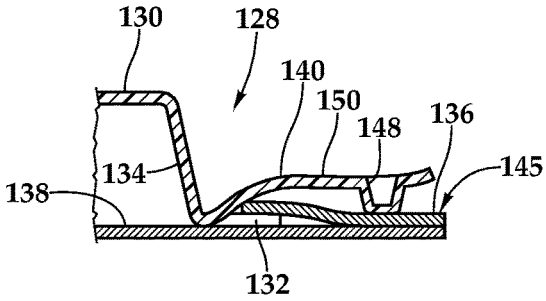
FIG. 12 is a fragmentary cross-sectional view of the package of FIG. 11 take along section line 12-12.

An alternative embodiment package 128, shown in FIGS. 11 and 12, has a thermoformed thermoplastic blister 130 with a peripheral flange 132 which extends outwardly from a product bubble 134 and which is trapped between a fiber front card 136 and a fiber back card 138. The front card has a bubble opening 144 through which the product bubble 134 extends. The bubble opening has a perimeter 146. Each card has an interior surface, and the interior surfaces of the cards 136 and 138 are glued together so that the glue does not adhere the flange 132 to either card. The front card 136 has an exterior surface 145 opposite the interior surface. An extraction tab 140 extends outwardly from the product bubble 134 frontwardly of the front card exterior surface 145, and may be formed in substantially the same plane as the flange 132, but is separated from the flange by two slots 142, one on each side of the tab, so that the flange extends beneath the top card, while the extraction tab 140 extends above the top card. The extraction tab 140 has an exterior perimeter 147.

As shown in FIG. 12, the extraction tab 140 has a downwardly protruding spacer segment 148 which engages the front card exterior surface 145 and extends away from the front card exterior surface to adjoin a grip segment 150 of the extraction tab. The spacer segment is formed inwardly of the extraction tab exterior perimeter 147 and the grip segment 150 is thus positioned by the button-like spacer segment 148 spaced from the front card, to be accessible on two opposed sides for gripping by a user to engage and remove the blister from the front card and the back card.

Figure 13:
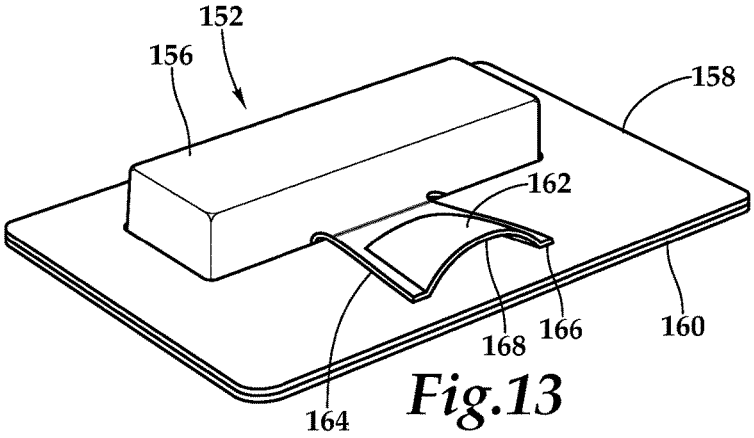
FIG. 13 is an isometric view of another alternative embodiment package of this invention.

An alternative embodiment package 152 is shown in FIG. 13 which has a blister 154 similar to the one of the embodiment 128 with a flange, not shown, which extends outwardly from a product bubble 156 and which is trapped between a front card 158 and a back card 160. An extraction flange 162 projects from the bubble 156 to extend over the front card 158 and has an exterior perimeter 164. A spacer segment 166 is located at the exterior perimeter, and extends frontwardly to adjoin a grip segment 168. The grip segment 168 defines a surface concave towards the front card 158 and accessible along a portion of the extraction tab exterior perimeter 164.

Figure 14:
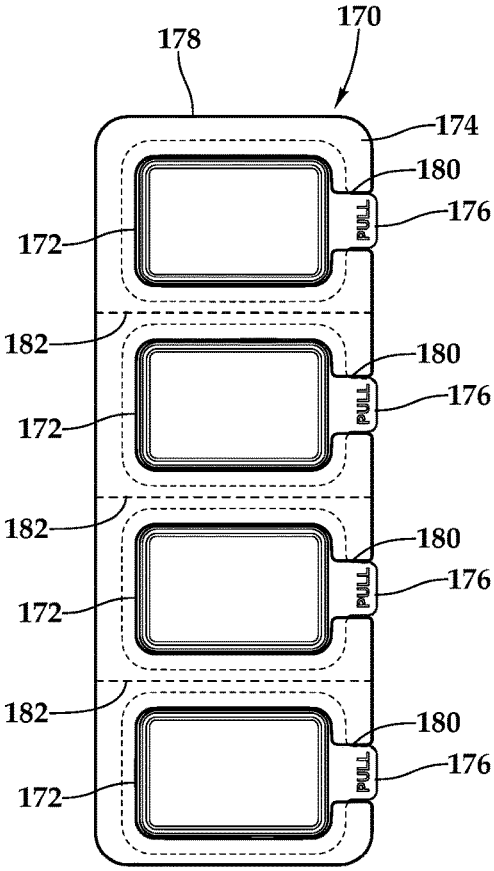
FIG. 14 is a front elevational view of an alternative embodiment package of this invention having a plurality of product bubbles.

An alternative embodiment package 170 is shown in FIG. 14, which has multiple independent blisters 172 each with a flange which is retained between a front card 174 which is adhered to a back card. Each blister 172 has an extraction tab 176 which extends to the exterior perimeter of the package and which is accessible from the front through a front card access opening 180 and a rear card access opening, similar to the openings 54 in the package 20, or 126 in the package 96. A series of perforations extending through the front and back cards define lines of weakened material 182 positioned between the individual blisters, such that the blisters and associated portions of the front and back cards can be separated from other portions of the front card and the back card and the other blisters. Such a package 170 can be used where products are produced as multi-packs, but used or sold individually.

Figure 15:
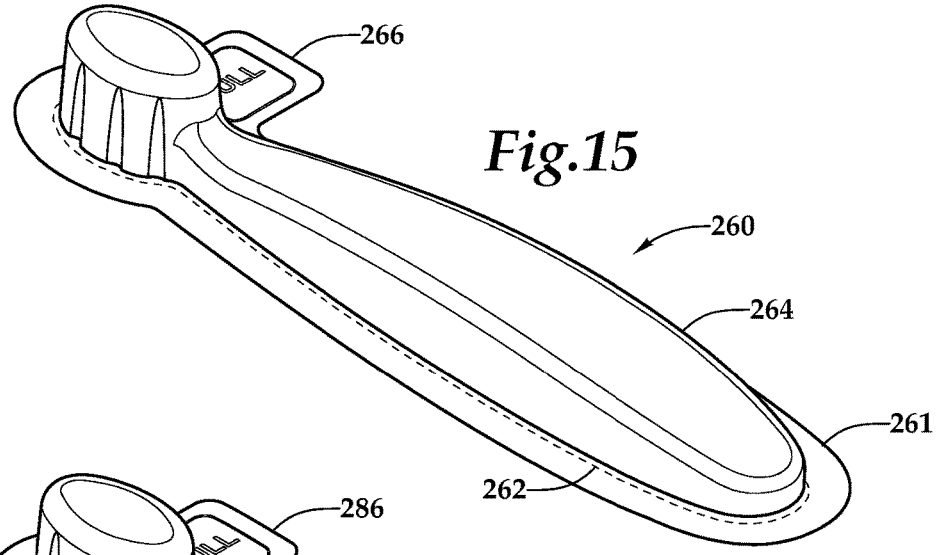
FIG. 15 is an isometric view of an alternative embodiment blister for a package of this invention in which the product bubble is separable from the blister flange along a line of weakened material.

An alternative embodiment blister 260 is shown in FIG. 15, for use with a front card and back card such as in the package 20 shown in FIGS. 1 and 2. As in the blister 30, the blister 260 has a peripheral flange 261 which is trapped between, but not adhered to, a front and back card. The blister 260 has a perforation which defines a line of weakened material 262 which substantially surrounds the product bubble 264, except where the extraction tab 266 extends from the bubble. As in the package 20, the extraction tab 266 is accessible from both the front and the back of the package.

The line of weakened material 262 defines a region where the product bubble 264 and extraction tab 266 are separable from the flange 261 in the removal of the blister from the front card and the back card. The blister 260 permits the product contained within the blister product bubble 264 to be readily accessed by separating the bubble along the line of weakened material 262. The separated bubble and the remaining flange can then be disposed of separately from the joined front and back cards.

Figure 16:
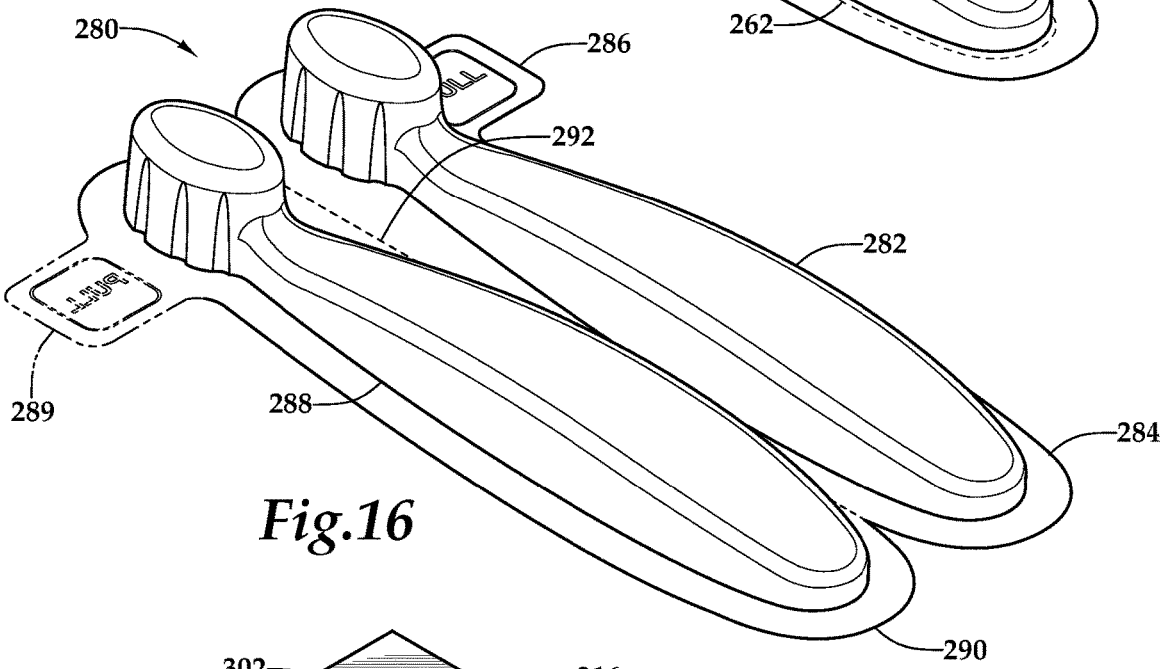
FIG. 16 is an isometric view of a thermoformed blister for a package of this invention having two hinged product bubbles.

An alternative embodiment clamshell blister 280 is shown in FIG. 16. The blister 280 has a front product bubble 282 with a peripheral flange 284 and a front extraction tab 286 which extend from the bubble. The blister 280 further has a back product bubble 288 with an extending peripheral flange 290 which adjoins the front bubble flange 284 along a hinge 292. In the as-formed condition, the front and back product bubbles both project in the same direction from the flanges 284, 290. Once the product is loaded, the blister 280 is folded about the hinge 292 to bring the front product bubble 282 and the back product bubble 288 together to define a product compartment which retains the product. The back card, not shown, is then provided with a rear product opening through which the back bubble 288 extends. If desired, the back flange 290 may also be provided with a back extraction tab 289 which in the loaded package will underlie the front extraction tab, such that the blister can be gripped from both sides to extract it from the joined front and back cards. The back extraction tab 289 may match or be offset from the front extraction tab 286.

Figure 17:
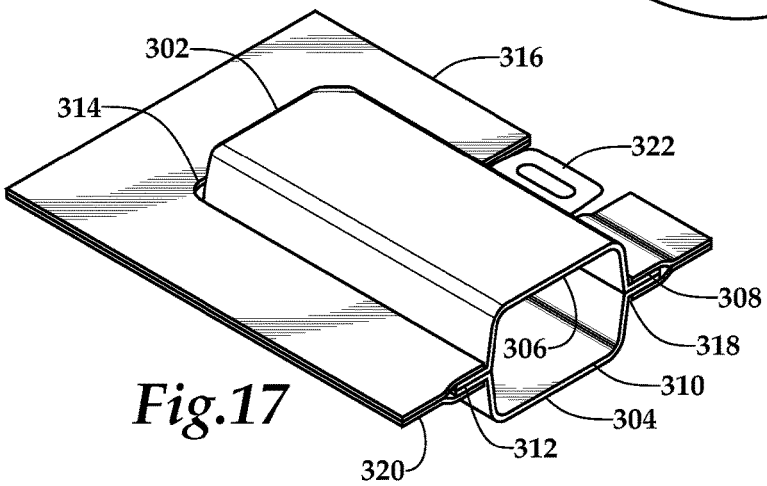
FIG. 17 is a cross-sectional isometric view of an alternative embodiment package of this invention having two product bubbles which define a product compartment when assembled.

An alternative embodiment package 300, as shown in FIG. 17, has a front blister 302 and a back blister 304 which are independent and need not be hinged to one another. The front blister 302 has a front product bubble 306 which extends from a front peripheral flange 308. The rear blister 304 has a back product bubble 310 which extends from a back peripheral flange 312. The front product bubble 306 projects through a front bubble opening 314 in a front card 316, and the back product bubble 310 projects in the opposite direction through a back bubble opening 318 in the back card 320. The front card 316 is adhesively attached to the back card 320 so as not to adhere the blister flanges 308, 312 to either card. An extraction tab 322 may be formed extending from one of the blisters 302, 304 or both, such that the one or both of the blisters may be engaged from both sides of the package for the distortion and extraction of the blisters from the attached cards. It should be noted that the front blister and the back blister may have featureless planar flanges, or they may be formed with protrusions and recesses, to allow the two pieces to be snapped together once they are removed from the paperboard cards to serve as a reusable storage container.

It is understood that the invention is not limited to the particular construction and arrangement of parts herein illustrated and described, but embraces all such modified forms thereof as come within the scope of the following claims.

We claim:

1. A package comprising:

a thermoformed thermoplastic blister having a protruding front product bubble with a peripheral flange which extends outwardly from the front product bubble, and a front extraction tab which extends from the front product bubble;

portions of the blister defining a back product bubble with an outwardly extending peripheral flange which adjoins the front product bubble flange along a hinge;

wherein the blister is folded about the hinge to bring the front product bubble flange and the back product bubble flange together so the flanges overlie one another and define a closed product compartment interior to the overlying flanges for retention of product therein;

a front card having an outer perimeter and having an exterior surface and an opposite interior surface, portions of the front card defining a bubble opening having an inner perimeter;

portions of the front card bubble opening which define a tab front access opening which extends from the outer perimeter of the front card to the inner perimeter of the front card;

a back card having an outer perimeter and having an interior surface which is connected to the front card interior surface, and an opposite exterior surface, wherein the back card has a rear product opening through which the back product bubble extends;

wherein the overlying blister flanges are retained between the front card and the back card so that the front product bubble extends through the front card bubble opening, wherein front product bubble peripheral flange and the back product peripheral flange are not adhered to the front card or the back card, and wherein the back product bubble underlies the entire front product bubble, and thereby closes the product bubble such that a volume for retaining and displaying a product is defined between the front product bubble and the back product bubble;

wherein the front extraction tab extends outwardly from the front product bubble and has a front surface and an opposite back surface, wherein the front extraction tab extends into the tab front access opening and is not overlain by the front card, such that the front extraction tab is free of the front card and extends beyond the outer perimeter of the back card to be accessible at both the tab front surface and the tab back surface without being blocked from access by the front card or the back card for gripping by a user to engage and remove the blister from the front card and the back card; and portions of the back card defining a notch along the outer perimeter of the back card which forms a tab back access opening, wherein the front extraction tab extends into the back access opening of the back card.

2. The package of claim 1 further comprising a back extraction tab which extends outwardly from the back product bubble to underlie the front extraction tab, such that the blister can be gripped from both sides to extract it from the joined front and back cards.

3. The package of claim 2 wherein the back extraction tab matches the front extraction tab.

4. The package of claim 2 wherein the back extraction tab is offset from the front extraction tab.

5. A package comprising:

a thermoformed thermoplastic blister having a protruding front product bubble with a peripheral flange which extends outwardly from the front product bubble, and a front extraction tab which extends from the front product bubble;

portions of the blister defining a back product bubble with an outwardly extending peripheral flange which adjoins the front product bubble flange along a hinge;

wherein the blister is folded about the hinge to bring the front product bubble flange and the back product bubble flange together so the flanges overlie one another and define a closed product compartment interior to the overlying flanges for retention of product therein;

a front card having an outer perimeter and having an exterior surface and an opposite interior surface, portions of the front card defining a bubble opening having an inner perimeter;

portions of the front card bubble opening which define a tab front access opening which extends from the outer perimeter of the front card to the inner perimeter of the front card;

a back card having an outer perimeter and having an interior surface which is connected to the front card interior surface, and an opposite exterior surface, wherein the back card has a rear product opening through which the back product bubble extends;

wherein the overlying blister flanges are retained between the front card and the back card so that the front product bubble extends through the front card bubble opening, wherein the blister flanges are not adhered to the front card or the back card, and wherein the closed product compartment interior is closed from exterior access for retaining and displaying a product between the front product bubble and the back product bubble;

wherein the front extraction tab extends outwardly from the front product bubble and has a front surface and an opposite back surface, wherein the front extraction tab extends into the tab front access opening and is not overlain by the front card, such that the front extraction tab is free of the front card and extends beyond the outer perimeter of the back card to be accessible for application of gripping engagement from both the tab front surface and the tab back surface without being blocked from access by the front card or the back card for gripping by a user to engage and remove the blister from the front card and the back card; and portions of the back card defining a region recessed from the outer perimeter of the back card which forms a tab back access opening, wherein the front extraction tab extends into the back access opening of the back card.

6. The package of claim 5 further comprising a back extraction tab which extends outwardly from the back product bubble to underlie the front extraction tab, such that the blister can be gripped from both sides of the combined front extraction tab and back extraction tab to extract it from the joined front and back cards.

7. The package of claim 6 wherein the back extraction tab matches the front extraction tab.

8. The package of claim 6 wherein the back extraction tab is offset from the front extraction tab.

* * * * *